US005212527A

United States Patent [19]

Fromm et al.

[11] Patent Number: 5,212,527

[45] Date of Patent: May 18, 1993

[54] DUAL MODE OIL APPLYING BLADE FOR APPLYING DIFFERENT OIL RATES DEPENDING ON OPERATING MODE OF AN IMAGE CREATION APPARATUS

[75] Inventors: Paul M. Fromm, Rochester; Rabin Moser, Victor, both of N.Y.

[73] Assignee: Xerox Corporation, Stamford, Conn.

[21] Appl. No.: 870,966

[22] Filed: Apr. 20, 1992

[51] Int. Cl.[5] ..... G03G 15/20

[52] U.S. Cl. ..... 355/284; 118/60; 118/DIG. 1

[58] Field of Search ..... 355/282, 284, 208; 118/60, DIG. 1; 432/60

[56] References Cited

U.S. PATENT DOCUMENTS

| | | | |
|---|---|---|---|
| 3,940,282 | 2/1976 | Hwa | 134/6 |
| 4,056,723 | 11/1977 | Springett et al. | 250/324 |
| 4,214,549 | 7/1980 | Moser | 118/60 |
| 4,231,653 | 11/1980 | Nagahara et al. | 118/DIG. 1 X |
| 4,264,191 | 4/1981 | Gerbasi et al. | 355/299 |
| 4,279,500 | 7/1981 | Kendo et al. | 355/299 |
| 4,285,295 | 8/1981 | Iwao et al. | 118/60 |
| 4,352,551 | 10/1982 | Iwao | 118/60 X |
| 4,593,992 | 6/1986 | Yoshinaga et al. | 355/284 |
| 4,905,049 | 2/1990 | Bickerstaff et al. | 355/284 |
| 4,942,433 | 7/1990 | Stuart | 355/284 |
| 5,099,289 | 3/1992 | Kurotori et al. | 355/284 X |

FOREIGN PATENT DOCUMENTS

| | | | |
|---|---|---|---|
| 0155376 | 12/1980 | Japan | 355/284 |
| 0132367 | 10/1981 | Japan | 118/60 |
| 0035569 | 3/1983 | Japan | 355/284 |
| 0047672 | 3/1987 | Japan | 355/284 |
| 0164075 | 7/1987 | Japan | 355/284 |
| 0107979 | 5/1991 | Japan | 355/284 |

*Primary Examiner*—A. T. Grimley
*Assistant Examiner*—William J. Royer

[57] ABSTRACT

A release agent management (RAM) system including a metering roll supported for contact with release agent material contained in a sump. A donor roll is provided for applying oil deposited thereon by the metering roll.

A metering blade structure for metering silicone oil onto the metering roll has two modes of operation. In one mode, a wiping action of a metering blade meters a relatively large quantity of silicone oil to the roll surface for accommodating the fusing of color toner images. In another mode of operation, a doctoring action is effected for metering a relatively small amount of silicone oil to the roll surface for accommodating the fusing of black toner images.

14 Claims, 4 Drawing Sheets

DUAL MODE OIL APPLYING BLADE FOR APPLYING DIFFERENT OIL RATES DEPENDING ON OPERATING MODE OF AN IMAGE CREATION APPARATUS

BACKGROUND OF THE INVENTION

The present invention relates to fuser apparatus for electrostatographic printing machines and in particular to release agent management (RAM) systems for a heat and pressure roll fuser.

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions of the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retrained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem it has been common practice to utilize toner release agents such as silicone oil, in particular, polydimethyl silicone oil, which is applied to the fuser roll surface to a thickness of the order of about 1 micron to act as a toner release material. These materials possess a relatively low surface energy and have been found to be materials that are suitable for use in the heated fuser roll environment. In practice, a thin layer of silicon oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface. Apparatus for applying the release agent material to a fuser member is commonly referred to as a release agent management (RAM) system.

While the foregoing comments apply equally to color and black and white fusers color fusers require certain features not found in fusers used for fixing only black toner. A color fuser typically runs at a lower speed than a fuser that has to fuse only a black toner image. A color image which typically comprises three or four pile heights requires more heat addition to provide the desired gloss and fusion of the toner. This additional heat stresses the release performance of the fuser roll so it is generally required to add more oil to the roll surface during color copying compared to black only or monochrome copying. Prior art blade metering systems do not provide this extra oil at lower speeds. In fact, the hydrodynamic forces produce the opposite effect, i.e. less oil at lower speed.

It has been shown that oil film thickness passing under a metering blade (blade acting in a plow, scraping or doctor mode) is not strongly effected by the load on the blade at a load high enough to produce intimate metering roll-blade contact. As load is reduced film thickness increases slightly until suddenly areas of the blade "float" allowing a drastic film thickness increase while other areas are at their previous thin film. On the other hand blades mounted in a swiper mode do exhibit fairly large film thickness changes as a function of load but it is difficult to ever get as thin a film as a metering mode blade can produce.

Various systems have been used to deliver release agent fluid to the fuser roll including the use of oil soaked rolls and wicks with and without supply sumps as well as oil impregnated webs. Another type of RAM system is disclosed in U.S. Pat. No. 4,214,549 granted to Rabin Moser on Jul. 29, 1980. As disclosed therein, release agent material is contained in a sump from which it is dispensed using a metering roll and a donor roll, the former of which contacts the release agent material and the latter of which contacts the surface of the heated fuser roll.

The use of multiple or redundant components for effecting the same results in a xerographic apparatus is well known as illustrated in U.S. Pat. Nos. Re. 29,032 and 4,056,723. In the former, multiple blades are used for the removal of residual toner particles from the surface of an imaging surface. The purpose of the multiple blades is to extend the life of the cleaning system. In the latter patent, a plurality of corona discharge devices are disclosed. When one of the discharge devices becomes unusable another one is readily moved into operative position, the purpose being to prolong the life of the charging system.

Japanese Patent publication No. 1-189513 published on Mar. 7, 1991 discloses a blade contacting a toner conveyor roller. The roll is rotated in both the clockwise and counterclockwise directions. The blade contacts the roller in a wiping mode regardless of the direction of rotation of the toner conveying roller.

U.S. Pat. No. 3,940,282 granted to Stephen C. P. Hwa on Feb. 24, 1976 discloses wiping and doctoring blades for removing toner and debris from an imaging surface wherein the wiper blade deflects toner and debris removed from the imaging surface into a toner sump.

U.S. Pat. Nos. 4,264,191 and 4,279,500 granted on Oct. 2, 1974 and Jul. 21, 1981 to Bruce E. Thorpe and Gerbasi et al, respectively disclose a blade which is pressure engaged with an imaging member. In each of these patents the blade is used in both the wiping and doctoring modes but in order to accomplish this the imaging member is reverse rotated.

U.S. patent application No. 07/689,392 filed on Apr. 22, 1991 in the name of Siegl et al and assigned to the same assignee as the instant application discloses a dual action cleaning blade one side of which is provided with an abrasive coating material. The dual action feature stems from the fact that when the surface to be cleaned is moved in one direction the side of the blade containing the abrasive material abrades the surface with a wiping action. When the surface to be cleaned moves in the opposite direction the opposite side of the blade does the wiping and thus the cleaning.

BRIEF SUMMARY OF THE INVENTION

Briefly, the present invention comprises a RAM system including a metering roll supported for contact with release agent material or oil contained in a sump and a donor roll which contacts the metering roll and a fuser roll. The oil is conveyed from the sump to the fuser roll via the donor roll. Alternately, the donor roll can contact the pressure roll. In that case, the oil is moved to the fuser roll between copies.

In one embodiment of the invention, a single rubber blade is mounted in a fashion that allows it to be retracted towards its mounted end away from the metering roll. The blade mounting is also capable of occupying two positions such that in one position it is in a metering mode and in the other it is in a swipper mode. This can provide the slow moving metering roll with a thick film with the blade in a swipper mode and a thinner film on the faster metering roll when the blade is in a metering mode. An additional benefit from moving the same blade from one position to the other, taking the short path; past the metering roll, is that the tip of the blade may be cleaned, or at least any contamination will be disturbed, as it is brushed past the metering roll. Also, excess oil on the blade tip will be reduced.

In another embodiment of the invention, a pair of blades is provided such that one blade is in contact with the metering roll at a time and by rotating the blade holder slightly the other blade would contact the roll. One blade contacts the metering roll in a swipper mode and the other blade contacts it in a metering mode. This has the advantage of not requiring any over-travel or retraction of the blade holder from one mode to the other. A drain hole in the blade holder permits proper oil drainage.

For a better understanding of the present invention, reference may be had to the accompanying drawings wherein the same reference numerals have been applied to like parts and wherein:

DESCRIPTION OF THE PREFERRED EMBODIMENTS

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
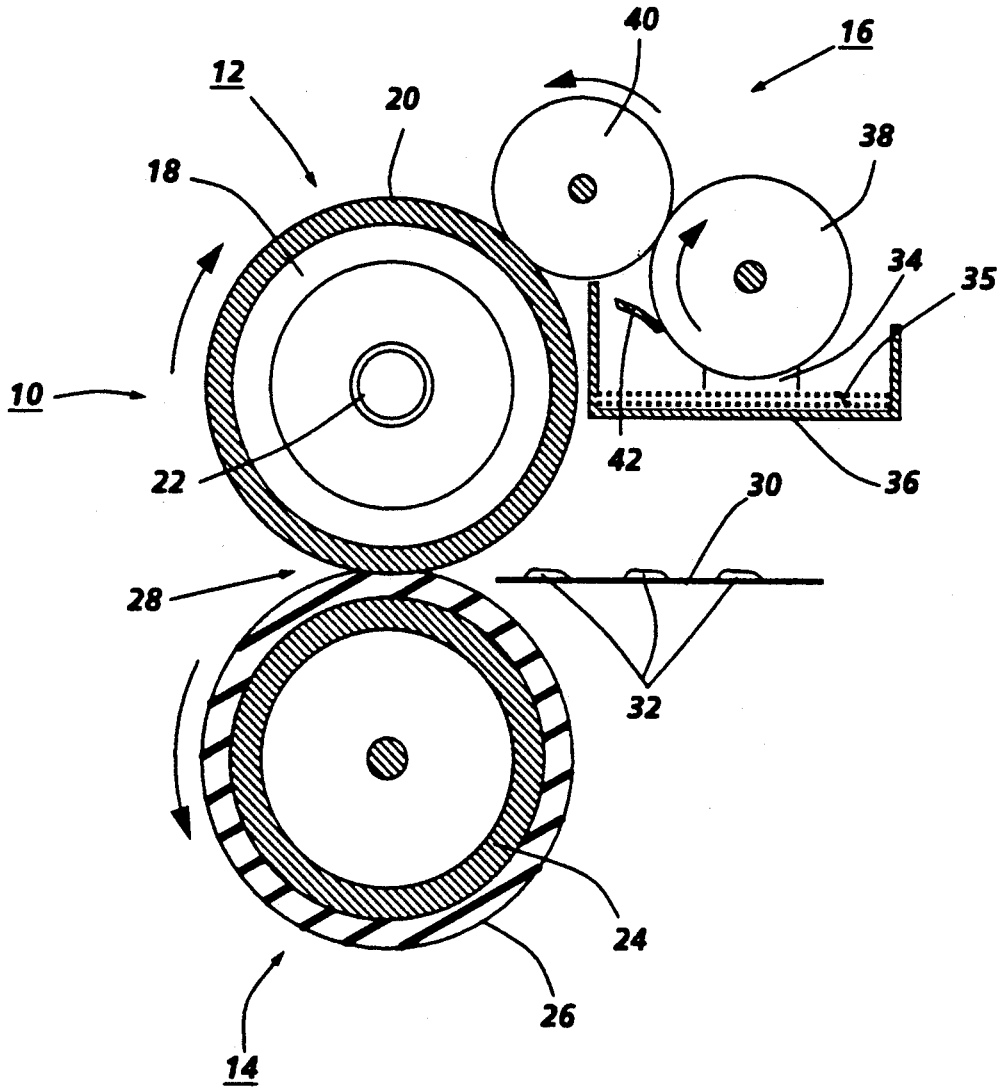
FIG. 1 (PRIOR ART)
FIG. 1 is a schematic illustration of a prior art fuser apparatus suitable for use of the present invention.

For a general understanding of the features of the present invention, reference is made to the drawings. In the drawings, like references have been used throughout to designate identical elements. FIG. 1 is a schematic illustration of a prior art fuser apparatus in which the present invention can be utilized.

Attention is now directed to FIG. 1 wherein a heat and pressure fuser apparatus 10 comprising heated fuser roll structure 12 and a pressure roll structure 14 are illustrated together with a release agent management (RAM) system 16. As shown in FIG. 1, the heated fuser roll structure 12 comprises a core 18 having thereon a layer 20 or layers of a suitable elastomer. The core 18 may be made of various metals such as iron, aluminum, nickel, stainless steel, etc., and various synthetic resins. Aluminum is preferred as the material for the core 18, although this is not critical. The core 18 is hollow and a heating element 22 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention and the fuser member can be heated by internal means, external means or a combination of both. Heating means are well known in the art for providing sufficient heat to fuse the toner to the support. The fusing elastomer layer may be made of any of the well known materials such as the Viton TM (trademark of E. I. duPont de Nemours & Co.) Teflon TM (trademark of E. I. duPont de Nemours & Co.) and/or silicone rubber.

The heated fuser roll structure 12 is shown in a pressure contact arrangement with the backup or pressure roll 14. The pressure roll 14 comprises a metal core 24 with an outer layer 26 of a heat-resistant material. In this assembly, both the fuser roll 12 and the pressure roll 14 are mounted on bearings (not shown) which are biased so that the fuser roll structure 12 and pressure roll structure 14 are pressed against each other under sufficient pressure to form a nip 28. It is in this nip that the fusing or fixing action takes place. The layer 26 may comprise any of the well known materials such as Teflon TM a trademark of E. I. duPont de Nemours & Co, Viton, silicone rubber or EPDM (ethylene-propylene diene monomer).

An image receiving member or final support 30 having toner images 32 thereon is moved through the nip 28 with the toner images contacting the heated fuser roll structure 12. The toner material forming the images 32 is prevented from offsetting to the surface of the fuser roll structure 12 through the application of a release agent material such as silicone oil 35 contained in sump 36.

The sump 36 and silicone oil 35 form part of the RAM system 16. The RAM system 16 comprises a metering roll structure 38 and a donor roll structure 40. The metering roll is supported so that it contacts a wick 34 impregnated with silicone oil 35 and is positioned to contact the donor roll for conveying silicone oil from the sump to the surface of the donor roll 40. The metering roll may also partially immersed in silicone oil. The donor roll is rotatably supported in contact with the metering roll and also in contact with the fuser roll 12. While the donor roll is illustrated as contacting the fuser roll, it will be appreciated that, alternately, it may contact the pressure roll 14. Also, the positions of the fuser and pressure rolls may be reversed and used in copiers or printers. A metering blade 42 supported in contact with the metering roll 38 serves to meter silicone oil to the required thickness on the metering roll.

Figure 2:
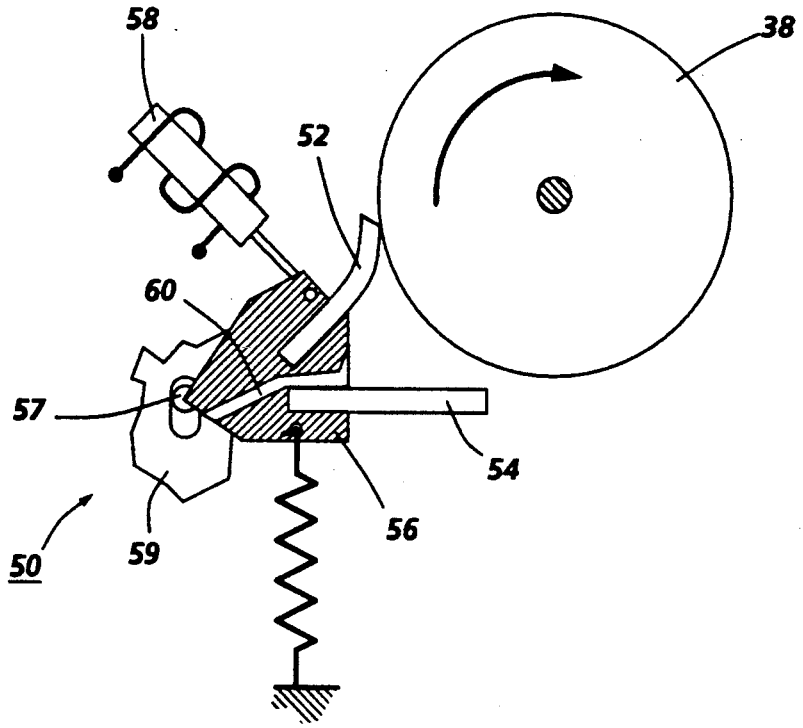
FIG. 2 is a schematic representation of a metering roll and one embodiment of a release agent management (RAM) system in one operative position.
Figure 3:
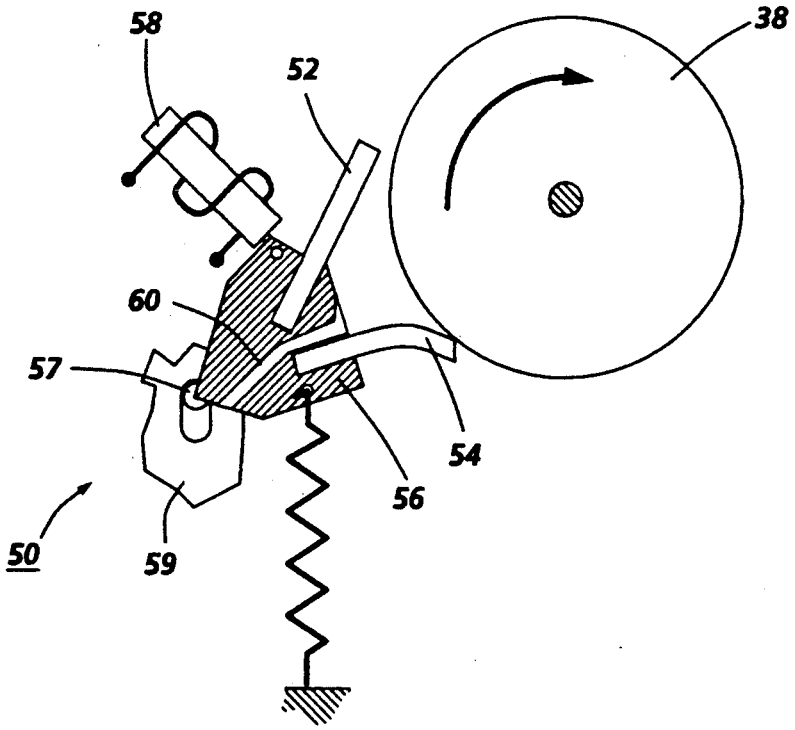
FIG. 3 is a schematic representation of a metering roll and release agent management (RAM) system according to FIG. 2 shown in a second mode of operation.

According to one embodiment of the invention as illustrated in FIGS. 2 and 3, a metering blade structure 50 comprises a pair of elastomeric blades 52 and 54 mounted in a blade holder 56. For the purpose of illustration, the blade holder 56 is normally urged in a clockwise direction about a shaft 57 captivated by a guide member 59 such that the blade 52 contacts the metering roll 38 in a wiping or swiping orientation as illustrated. This orientation of the blade holder provides for a first mode of operation in which a larger quantity of silicone oil is applied to the roll 38 while the roll rotates at a relatively low angular speed. This mode of operation is utilized for fusing or fixing high pile height color toner images. The metering roll is driven by the donor roll which, in turn, is driven by the fuser roll.

A solenoid device 58 serves when actuated to shift the blade holder to the position shown in FIG. 3. In this position the blade 54 is brought into engagement with the metering roll 38 such that it provides a doctoring action. Simultaneously, contact between the blade 52 and the metering roll is terminated. This orientation of the blade 54 relative to the roll 38 provides for a second mode of operation wherein a lesser quantity of oil is applied onto the roll 38 which is being rotated at a relatively higher speed than in the other mode of operation. This mode accommodates the fusing of relatively lower pile height black toner images at relatively high speeds.

A drain hole 60 in the blade holder 56 provides for drainage of excessive amounts of the silicone oil. The metering roll structure 38 serves to convey low (100 cs) viscosity silicone oil from a sump (not shown) similar to the sump 36 shown in FIG. 1. Rotational speed of the metering roll and the orientation of the metering blade structure relative to the metering roll 38 determine the quantity of silicone oil metered to the roll.

In the first mode of operation wherein the blade 52 contacts the roll 38 in a wiping fashion, the roll is rotated at a relatively slow speed and a relatively large (i.e. 10 $\mu$l per copy) quantity of silicone oil is dispensed to the surface of the roll 38.

In the second mode of operation wherein the blade 54 contacts the roll 38 in a doctoring fashion, the metering roll 38 is rotated at a relatively high speed consistent with RAM systems used for fusing monochromatic images. In this mode of operation a relatively small (i.e. 4 $\mu$l per copy) amount of silicone is applied to the surface of the roll 38.

Figure 4:
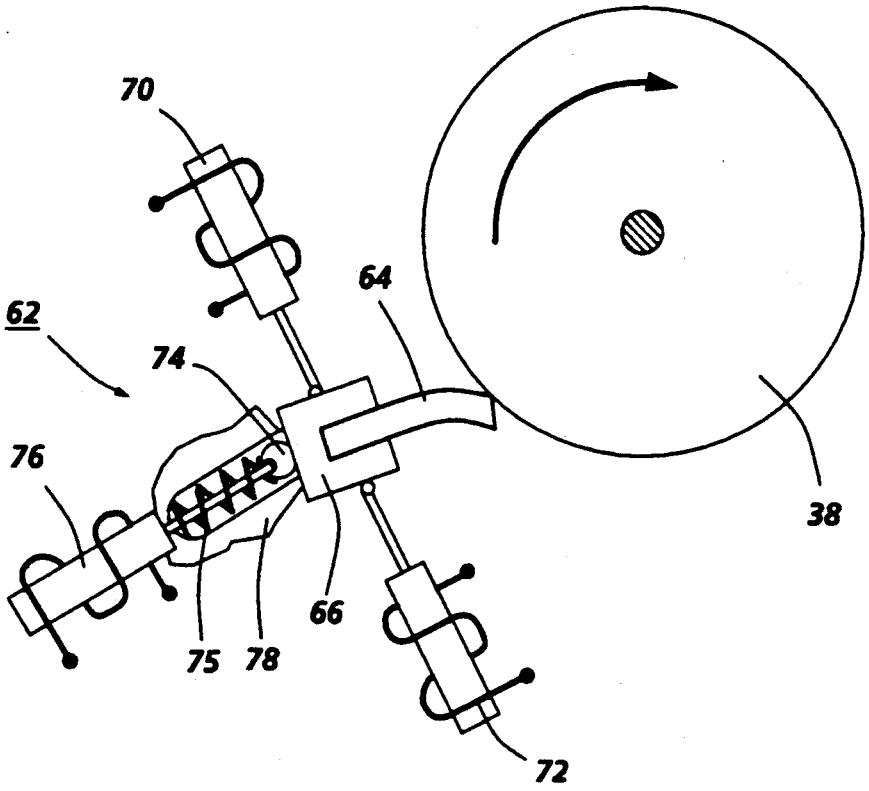
FIG. 4 is a schematic representation of another embodiment of a metering roll and release agent management (RAM) system illustrated in one mode of operation.
Figure 5:
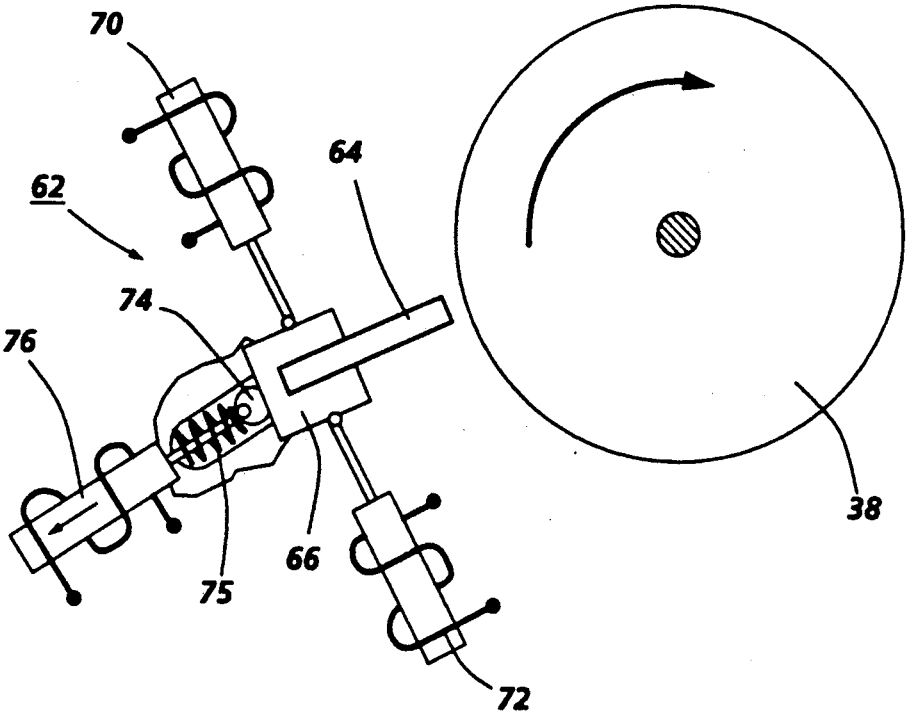
FIG. 5 is a schematic representation of the metering roll and release agent management (RAM) system of FIG. 4 illustrated in an intermediate position during change over from one mode of operation to another.
Figure 6:
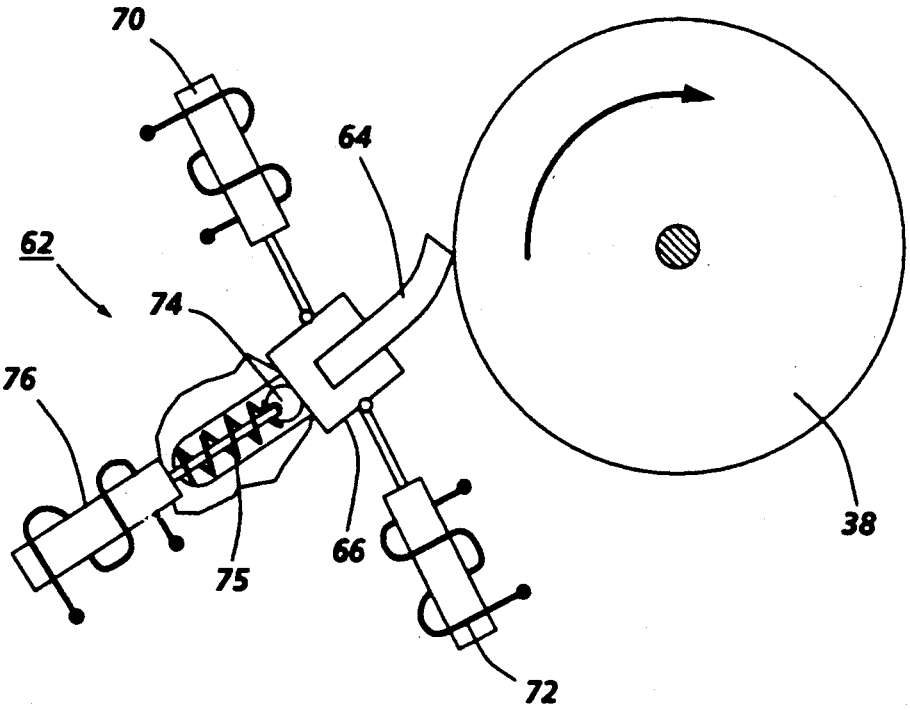
FIG. 6 is a schematic representation of a the embodiment of FIG. 4 shown in a second mode of operation.

In accordance with another embodiment of the invention illustrated in FIGS. 4 through 6, a metering blade structure 62 is provided which comprises a single blade 64 carried by a blade holder structure 66. The blade is fabricated, as are the blades 52 and 54, from a suitable elastomeric material of the type normally used in RAM systems of the type referred to herein. The blade structure is adapted to be pivoted from a wiping position as shown in FIG. 4 to the doctoring orientation illustrated in FIG. 6. The functioning of the blade 64 in the position shown in FIG. 4 is the same as that of the blade 54 while the functioning of the blade 64 in the position shown in FIG. 5 is the same as the blade 52.

A pair of solenoids 70 and 72 attached to opposite sides of the blade holder structure 66 serve to effect pivotal movement of the blade holder structure about a support shaft 74 between its two operative positions shown in FIGS. 4 and 6. When energized the solenoid 70 pivots the blade holder structure to the position shown in FIG. 4 while the solenoid 72 serves to move it to the position shown in FIGS. 5 and 6.

A spring 75 disposed in a spring retainer 78 serves to urge the blade holder structure in a radial direction relative to the roll 38. Retraction of the blade holder structure 66 against the mechanical bias of the spring reduces the forces required by the solenoids 70 and 72 for pivoting the blade holder through its over-center position. A solenoid 76 attached to the shaft 74 is provided for effecting retraction of the blade holder structure 66 in the radial direction for facilitating movement thereof between its operative positions.

What is claimed is:

1. Apparatus for applying offset preventing liquid to one member of a contact fuser for fixing powder images to a substrate wherein the contact fuser includes a supply of release agent material, a release agent metering member supported for contact with said supply of release agent material and a donor member contacting the metering member and a fuser member, said apparatus comprising:

a release agent metering member supported for movement in an endless path and contact with a supply of release agent material;

a blade structure for pressure contacting said metering member in a first mode of operation for applying a predetermined quantity of release agent material to the surface of said metering member and for pressure contacting said metering member in a second mode of operation for metering a quantity of release agent material to said metering member which is less than said predetermined quantity of release agent material.

2. Apparatus according to claim 1 wherein said donor and metering members comprise roll structures and said supply of release agent material includes a sump containing said release agent material.

3. Apparatus according to claim 1 wherein said blade structure for pressure contacting said metering member comprises a pair of blades.

4. Apparatus according to claim 3 including means for supporting said pair of blades and positioning them such that only one of them contacts said metering member at a time.

5. Apparatus according to claim 4 wherein said means for supporting said pair of blades effects pressure contact of one of said blades with a wiping action against said metering roll during said first mode of operation

6. Apparatus according to claim 5 wherein said means for supporting said pair of blades effects pressure contact of the other of said pair of blades with a doctoring action against said metering roll during said second mode of operation.

7. Apparatus according to claim 1 including means for moving said blade structure between two operative positions, one corresponding to said first mode of operation where said blade structure contacts said metering roll with a wiping action and the other corresponds to said second mode of operation where said blade structure contacts said metering member with a doctoring action.

8. A method of applying offset preventing liquid to one member of a contact fuser for fixing powder images to a substrate wherein the contact fuser includes a supply of release agent material, a release agent metering member supported for contact with said supply of release agent material and a donor member contacting the metering member and a fuser member, said method including the steps of:

supporting a metering member for movement in an endless path while contacting a supply of release agent material;

in a first mode of operation, applying a predetermined quantity of release agent material to the surface of said metering member with a blade structure and in a second mode of operation, applying a quantity of release agent material to said metering member with said blade structure which is less than said predetermined quantity of release agent material.

9. The method according to claim 8 wherein said donor and metering members comprise roll structures and said supply of release agent material includes a sump containing said release agent material.

10. The method according to claim 8 wherein said step of applying a quantity of release agent material to said metering member which is less than said predetermined quantity of release agent material comprises using a pair of blades.

11. The method according to claim 10 including the step of supporting said pair of blades and positioning them such that only one of them contacts said metering member at a time.

12. The method according to claim 11 including the step of effecting pressure contact of one of said pair of blades with a wiping action against said metering roll.

13. The method according to claim 12 including the step of effecting pressure contact of the other of said blades with a doctoring action against said metering roll.

14. The method according to claim 8 including the step of moving said blade structure between two operative positions, one corresponding to said first mode of operation where said blade structure contacts said metering roll with a wiping action and another operative position corresponding to said second mode of operation where said blade structure contacts said metering member with a doctoring action.

* * * * *